United States Patent [19]

Weitzner

[11] 4,112,553

[45] Sep. 12, 1978

[54] SLIDE FASTENER BOTTOM ENDS

[76] Inventor: Jonas Weitzner, Cespedes 3857, Buenos Aires, Argentina

[21] Appl. No.: 770,375

[22] Filed: Feb. 22, 1977

[30] Foreign Application Priority Data

May 28, 1976 [AR] Argentina ..... 263438

[51] Int. Cl.[2] ..... A44B 19/36
[52] U.S. Cl. ..... 24/205.11 R
[58] Field of Search ..... 24/205.11 R, 205.11 F

[56] References Cited

U.S. PATENT DOCUMENTS

| | | | |
|---|---|---|---|
| 2,146,691 | 2/1939 | Sundback | 24/205.11 R |
| 2,192,013 | 2/1940 | Marinsky | 24/205.11 R |
| 2,588,648 | 3/1952 | Moehler | 24/205.11 R |
| 3,254,384 | 6/1966 | Plavin | 24/205.11 R |

FOREIGN PATENT DOCUMENTS

| | | | |
|---|---|---|---|
| 147,602 | 7/1952 | Australia | 24/205.11 R |
| 572,012 | 3/1959 | Canada | 24/205.11 R |
| 1,040,022 | 10/1953 | France | 24/205.11 R |
| 622,318 | 4/1949 | United Kingdom | 24/205.11 R |

*Primary Examiner*—Bernard A. Gelak
*Attorney, Agent, or Firm*—McGlew and Tuttle

[57] ABSTRACT

A bottom stop member for slide fasteners in which the bottom ends of the chains of interlocking elements are detachable, the stop member having two lateral grooves into which the end members of both chains are seated. One of the chains are fastened to the stop member by teeth in one lateral slot of the stop member that engages into corresponding recesses in the end member of the chain while the end member of the adjacent chain is being detachable since its corresponding lateral slot has no teeth. The stop member and the chains are made of the same injection molded plastic material.

5 Claims, 3 Drawing Figures

SLIDE FASTENER BOTTOM ENDS

BACKGROUND OF THE INVENTION

1. Field of the Invention

This invention relates in general to an improvement in slide fastener bottom stop members and particularly to a plastic bottom stop member for slide fasteners.

2. Description of the Prior Art

In present plastic slide fasteners, the stop members joining the bottom ends are fixed to one of the slide fastener chains by denting, and therefore the member must be manufactured of a material capable of being deformed during the denting operation.

Due to the aforesaid requirement the stop members are manufactured from a metallic alloy which is deformable during the denting operation.

The known metallic stop member is usually painted with the same color as the slide fastener plastic material. For this reason, the denting must be done at a concealed location that will not effect the look of the stop member due to the cracking in the paint surface at the location where the denting operation is performed. This requirement causes the denting operation to become very complicated.

Another disadvantage of this type of stop members is the fact that since it is made of painted metal, the natural tendency is for the paint to become worn and chipped of the surface, with use and to impare the look of the member.

SUMMARY OF THE INVENTION

The main object of the invention is to provide a slide fastener bottom stop member, against which the slider abuts in one of the chains while for the other chain is the insertion clement, and the stop member having partition wall defining two grooves with closed ends, the facing edges of the groove defining lateral slots, the novelty lying in that in the slot associated with the chain in which the stop member is fastened, the facing edges of the grooves are provided with teeth inserted in corresponding recesses of the chain end.

In a preferred embodiment of the invention the teeth in the side receiving the chain have a slight lateral slope facing the groove opening while the other side of the teeth have a substantially vertical face.

A further object is to provide a slide fastener that is made of the same material as the chain and that is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF PREFERRED EMBODIMENTS

Figure 1:
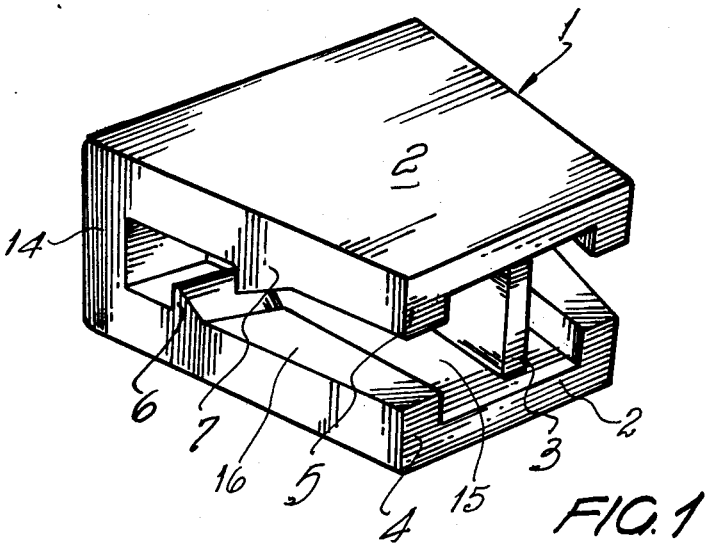
FIG. 1 is a perspective view of the stop member.

Referring to the drawings in particular, the invention embodied comprises a stop member for a slide fastener.

As can be seen in FIG. 1, the stop member generally designated 1 has two face portions 2, 2 with a trapezoidal, flat shape that are separated by a partition wall 3 and a web 14. These elements define a groove or U-shaped housing 15 in which the ends of the fastener chains are introduced.

These grooves have edges facing each other formed by the flanges 4 and 5, defining a slot 16.

In FIG. 1 only the left side slot 16 is shown to which the end of the slide fastener chain is fastened. Teeth or projections 6 and 7 extend inwardly from respective flanges 4 and 5.

In the preferred embodiment of the invention, shown in the drawings, only two teeth are shown placed alternatively or offset from each other. The stop member may have several teeth in each flange, and placed facing each other instead of offset.

Figure 2:
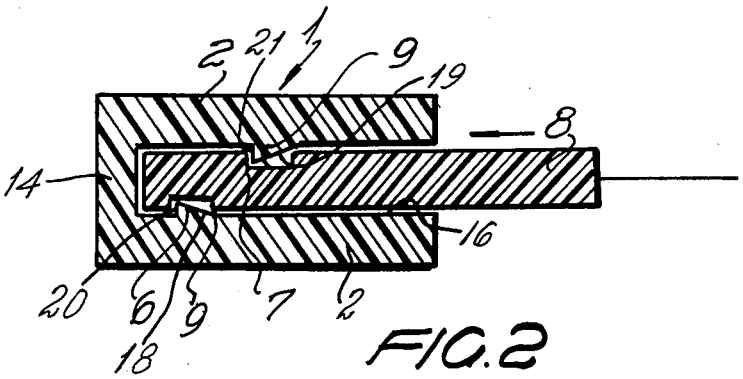
FIG. 2 is a side crossectional view of the stop member placed over a chain bottom end member.

FIG. 2 shows how the end 8 of the chain becomes locked within the stop member 1, once the teeth 6 and 7 of the stop member engage into the corresponding recesses 9 of the end member 8.

The arrow indicates the direction of penetration of the end member 8 in the stop member 1 during the assembling operation and in the aforementioned Figure can also be seen how the end member, 8 stays locked in the stop member 1 due to the shape of teeth 6 and 7.

When the end member 8 penetrates the stop member 1, it collides against the sides 18, 19 of the teeth 6 and 7 which are inclined.

If the end member 8 is further displaced in the direction of the arrow, the stop member 1 is slightly deformed, separating flanges 4 and 5. Once the end member 8 reaches the bottom of the groove 15 adjacent the web 14 in the stop member 1, the teeth penetrate into corresponding recesses 9, 9 of the end member 8, becoming locked due to the edges of recesses 9 laying against the vertical sides 20, 21 of teeth 6 and 7.

Although in FIG. 2 only two teeth 6 and 7 are shown placed alternatively and also two corresponding recesses 9, the stop member 1 may have more teeth, that also may face each other, and the end member 8 may also have more corresponding recesses.

Figure 3:
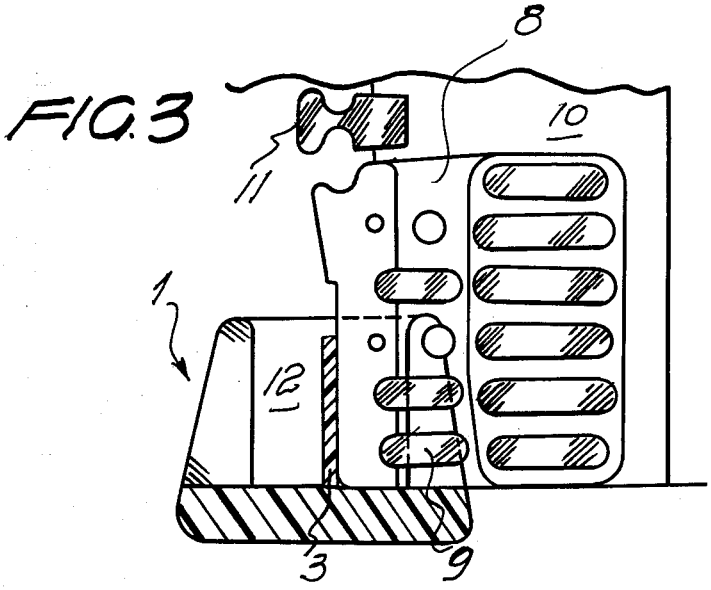
FIG. 3 is a front view of the stop member, in section, placed in a chain bottom end member.

FIG. 3 shows the preferred shape of the end member 8 of a slide fastener manufactured by plastic injection moulding over a fabric ribbon 10, over which also the interlocking elements are injected the Figure showing only the last interlocking element 11 of the chain.

The stop member 1, shown in section, rests, via the wall 3, against one of the lateral edges of the end member 8, and the enlarged part there of remaining wedged in one of the symetric groove 12, from which it cannot come out because flanges 4 and 5 surpass and avoids it.

In the end member 8, shown in FIG. 3, recesses 9, seen from above, have a substantially oval shape, having two on each face of end 8.

The stop member 1 of the present invention is preferably manufactured from injection moulded plastic, the same as ends 8 and chain interlocking elements 11, hence using the same material for all of them, having exactly the same color and corrosion resistance.

While specific embodiments of the invention have been shown and described in detail to illustrate the application of the principles of the invention, it will be understood that the invention may be embodied otherwise without departing from such principles.

I claim:

1. A stop member for retaining the two ends of a slide fastener, at least one end having a surface with at least one locking recess defined thereon, comprising, a top and bottom face portion spaced from and facing each other, a web portion connected between adjacent edges of said top and bottom face portions, said face portions and web portion forming a groove, a partition connected between said top and bottom face portions dividing said groove into first and second groove spaces for admitting the respective ends of the slide fastener, flange means extending into said groove from lateral edges of said top and bottom face portions to form a slot therebetween in each groove space, and at least one of said flange means in said first groove space including at least one tooth extending into said slot, said tooth having an inclined surface sloping inwardly toward said slot in the direction of said web portion, and having a vertical surface facing said web, the slide fastener end having at least one recess thereon being lockably engageable into said first groove space by said tooth engaging into said recess.

2. A stop member according to claim 1 further comprising at least one tooth on both of said flange means in said first groove space facing each other, one of the slide fastener ends including a corresponding number of recesses engageable with said tooth means to retain that fastener end into said stop member.

3. A stop member according to claim 1 further including at least one tooth on both of said flange means in said first groove space at offset positions from each other on said flange means, one of the slide fastener ends including a corresponding number of recesses engageable with said tooth means to retain the fastener end into said stop member.

4. A stop member according to claim 1 manufactured by plastic injection moulding.

5. A plastic stop member connectable to one end of a plastic slide fastener and retaining the other end of the slide fastener comprising, a U-shaped housing defining a groove, a partition in said housing dividing said groove into first and second groove spaces, flanges extending into each of said groove said groove spaces from lateral edges of said U-shaped housing, each of said flanges in said first groove space including at least one inwardly inclining tooth having a vertical locking face facing the base of said U-shaped housing, the connected slide fastener end having a locking recess corresponding with each of said teeth and being connected to said stop member by engagement of said teeth into said corresponding locking recess.

* * * * *